US005855372A

United States Patent [19]

Thiemann

[11] Patent Number: 5,855,372

[45] Date of Patent: Jan. 5, 1999

[54] WATER TARGET GAME

[76] Inventor: Gerry B. Thiemann, 2343 Van Leunen Dr., Cincinnati, Ohio 45239

[21] Appl. No.: 75,995

[22] Filed: May 11, 1998

Related U.S. Application Data

[60] Provisional application No. 60/047,459 May 22, 1997.

[51] Int. Cl.[6] ..... A63B 67/00

[52] U.S. Cl. ..... 273/349

[58] Field of Search ..... 273/349

[56] References Cited

U.S. PATENT DOCUMENTS

| | | | |
|---|---|---|---|
| 1,258,931 | 3/1918 | Newcombe | 273/402 |
| 3,843,127 | 10/1974 | Lack | 273/349 |
| 4,165,073 | 8/1979 | Kellerstrass | 273/349 |
| 4,412,680 | 11/1983 | Zorn | 273/349 |
| 4,909,518 | 3/1990 | Erlandson et al. | 273/357 |
| 5,011,161 | 4/1991 | Galphin | 273/349 |
| 5,064,195 | 11/1991 | McMahan et al. | 273/374 X |
| 5,087,054 | 2/1992 | O'Neil | 273/384 |
| 5,192,080 | 3/1993 | Duncan | 273/412 |
| 5,390,913 | 2/1995 | Kepler | 473/472 |
| 5,586,767 | 12/1996 | Bohlano | 273/349 |

*Primary Examiner*—William H. Grieb

[57] ABSTRACT

A water target game played with a ball or projectile for use in places such as amusement parks or the home is disclosed. The preferred embodiment consists of a circular target supported by a pole which is placed between two pods with spray nozzles. A water supply hose connects to the base of the target. Inside the base are control valves which regulate the flow of water to the spray nozzles in the pods. A motion sensor is located in the circular target. Indicator lights prompt players when to throw a projectile through the target. A control unit connects to the motion sensor, indicator lights and control valves. A player(s) stands on each pod holding a projectile. An indicator light flashes on the pole prompting the player(s) on one pod to throw. If the player(s) successfully throws the projectile through the target, the motion sensor signals to the control unit to activate the valves whereby water is sprayed on the opposing player. If the player(s) misses the target, the control unit will signal another valve to activate and release water through the nozzles on the pod where the player(s) is standing, thereby penalizing him. The device can also be reprogrammed to change the rules of the game in other embodiments. The device can have modified embodiments to be used in conjunction with water slides, in swimming pools or can be electronically linked to several devices of the same to form a larger attraction.

20 Claims, 3 Drawing Sheets

WATER TARGET GAME

BACKGROUND OF THE INVENTION

This is a provisional appllication Ser. No. 60/047,459 filed May 22, 1997.

The present invention generally relates to amusement equipment, such as facilities for games and other competitive activities. More specifically, the invention relates to a water amusement target game in which participants are subject to being sprayed with water under certain game conditions.

In recent years, there has been an increase in the development and popularity of amusement parks which have as a major theme water rides and games. Such amusement parks frequently include wave pools, variously configured water slides, inner tube rides, games with water balloons, and floating rivers where individuals wearing bathing suits may participate in the water rides and games for a general admission price. As amusement parks having a water theme become more popular, there has become a need for more diverse and varied water rides or games which can be offered in order to attract individuals to the theme park. Particularly, this is true for water amusement games which have become a major attraction.

In addition to the large amusement parks, smaller parks, built on land less than an acre in size to a few acres, and consisting of a few attractions such as miniature golf, batting cages, Go-Kart tracks, and video arcades also have a need for new attractions to attract new customers and keep current customers coming back. These new attractions must take up little space and require low capital investment. These parks are open during the hot summer months. Often, during the hottest time of the day —the afternoon, these parks have low attendance as customers prefer to patronized their parks during the cooler evening hours. There is a need to offer an attraction at these parks which would entice people to attend during the hot, off peak hours such as a water amusement game.

An example of an amusement game utilizing water is, U.S. Pat. No. 5,390,913 to Kepler, called Basketball Game With Water Spray System. This game consists of a facility and equipment for playing a game similar to basketball. There is a sensor in the hoop or basket which detects when a ball has successfully passed through. A mechanism keeps score as to which team makes more baskets. When the game is over, the losing team is doused with a spray of water.

As taught by U.S. Pat. No. 5,011,161 to Galphin, discloses a Water Amusement Game where opposing players stationed in pads resembling submarines fire water cannons at a target. The target is moved by the force of the water fired from the canons. A sensor detects the movement of the target and causes water to be squirted at the players who are less successful at firing the water canon at the target. As the target is forced by the water from the canons closer to the losing players, a switch is tripped and the door of the submarine is locked and a drenching amount of water is dumped on the losing team and audible sounds are emitted giving the impression that the submarine is sinking.

Another example of a game utilizing water is U.S. Pat. No. 4,909,518 to Erlandson et al, which discloses a Water Balloon Game. In this game, players position themselves inside booths, each booth positioned at an opposite end inside an enclosed area, and launch water balloons via a sling shot at each other. A successful shot will cause the water balloon to strike an overhead protector with small openings on the opposing booth. The impact of the balloon on the protector causes the balloon to burst and douse the opposing player(s) within the enclosure with water which passes through the openings of the overhead protector.

From the above discussion, it can be appreciated that prior art does utilize water in games to increase the enjoyment of the activities and cause its participants to get wet. However, each game has inherent characteristics that limit its desirability to amusement park operators. The Basketball Game with Water Spray System can be dangerous when the playing surface gets wet and participants must run and dribble on wet surfaces. In addition, wet surfaces make it hard to dribble a ball. The Water Amusement Game is a very complex game where participants are enclosed in "submarines". If participants are claustrophobic or easily panicked then when the doors shut and the players are doused, participants could be caused undue psychological harm. These games are very complex with sophisticated mechanisms making the possibility of breakdowns more likely, increasing maintenance costs, and ultimately increase the overall purchase price of the games. The Water Balloon Game requires operators to fill hundreds of balloons at the beginning of each day by hand. This requires a lot of time during the short preparation time operators have before they open their parks. It also requires additional man-hours which add to the cost of the amusement park. Also, the players in this game are confined to the booths which severely limit their mobility. This gives participants an enclosed feeling and reduces the enjoyment of the game.

The present invention is a relatively inexpensive game for amusement operators to purchase. It has fewer parts than much of the prior art (U.S. Pat. Nos.5,390,913 and 5,011,161) which may result in less maintenance and down-time. It can be played on safe surfaces such as sand, gravel, non-skid soft synthetic surfaces. It requires less space. Compared to the Water Balloon Game, it requires no set-up time such as filling balloons with water and it is more open since participants do not have to play inside a booth. Prior art is also limited to narrow applications in well defined areas. It would be desirable if a game could be utilized in a number of settings of various sizes or appearances or combined with other attractions in an amusement park to enhance the enjoyment or reduce the boring experience of waiting in long lines.

BRIEF SUMMARY OF THE INVENTION

In accordance with the purposes of the present invention as described herein, a water target game is provided having a free standing substantially centrally disposed target. The free standing target generally comprises an upper frame portion defining a target space preferably supported by means of an elongated pole disposed on a substantially flat support stand. Although the frame may be of substantially any configuration, preferably the frame defines a circular target area. Disposed in proximity with the target frame is a motion detector for detecting when a projectile passes through the frame. The target preferably separates two or more spaced substantially flat player pods having spray nozzles imbedded therein. Preferably, one player, or team of players, stands on each of two pods. When one player successfully throws a projectile such as a ball or a flying disc through the target, thus activating the motion detector, water nozzles in the opposing player's pods are activated and the opposing players or teams are thus doused.

In the preferred embodiment, one or more signal lights are attached to either side of the target and facing each player or team of players. A control box is provided that is connected to the lights, motion detector, and the valves regulating the water flow to the spray nozzles on the pod. The control box regulates the illumination of the lights and essentially dictates the pace of the game. In one version of the game, a first, preferably green, signal light facing a first pod is steadily illuminated for a period of time, and subsequently begins flashing for a predetermined amount of time. During this flashing period, the player on the first pod must throw the projectile through the target frame. If the player successfully throws the projectile through the target, a motion detector embedded in the target senses the projectile and signals to the control unit to open the valves, sending water to the nozzles in the pod of the opposing team which douses them with water. If the throw is wide or late, the control unit signals the valve to open on the unsuccessful player's pod. Once the nozzles on either pod are activated and sprayed, a second preferably red light illuminates on the side of the losing player for a brief period of time and the cycle starts again. The first preferably green indicator light facing the second pod will illuminate for a brief period of time before flashing for a predetermined amount of time. While the indicator light facing the second pod is flashing, the second player or team of players must successfully throw the projectile through the target frame in order to soak the opposing player and to avoid getting wet themselves.

Still other objects of the present invention will become apparent to those skilled in this art from the following description wherein there is shown and described a preferred embodiment of this invention, simply by way of illustration. As will be realized, the invention is capable of other different embodiments, and that several details are capable of modification and various, obvious aspects all without departing from the invention. Accordingly, the drawings and descriptions will be regarded as illustrative in nature and not restrictive.

BRIEF DESCRIPTION OF THE DRAWINGS

The accompanying drawings incorporated in and forming a part of the specification illustrate several aspects of the present invention, and together with the description, serve to explain the principals of the invention. In the drawing.

DETAILED DESCRIPTION OF THE PREFERRED EMBODIMENT

Reference will now be made in detail to a preferred embodiment of the invention, an example of which is illustrated in the accompanying drawings, wherein like numerals indicate the same elements throughout the 'views'. With references to FIGS. 1–3, the target game of the present invention generally comprises a free-standing projectile target 10 centrally disposed between first and second player pods 32, 34 upon which opposing players or teams of players are positioned during play.

Figure 1:
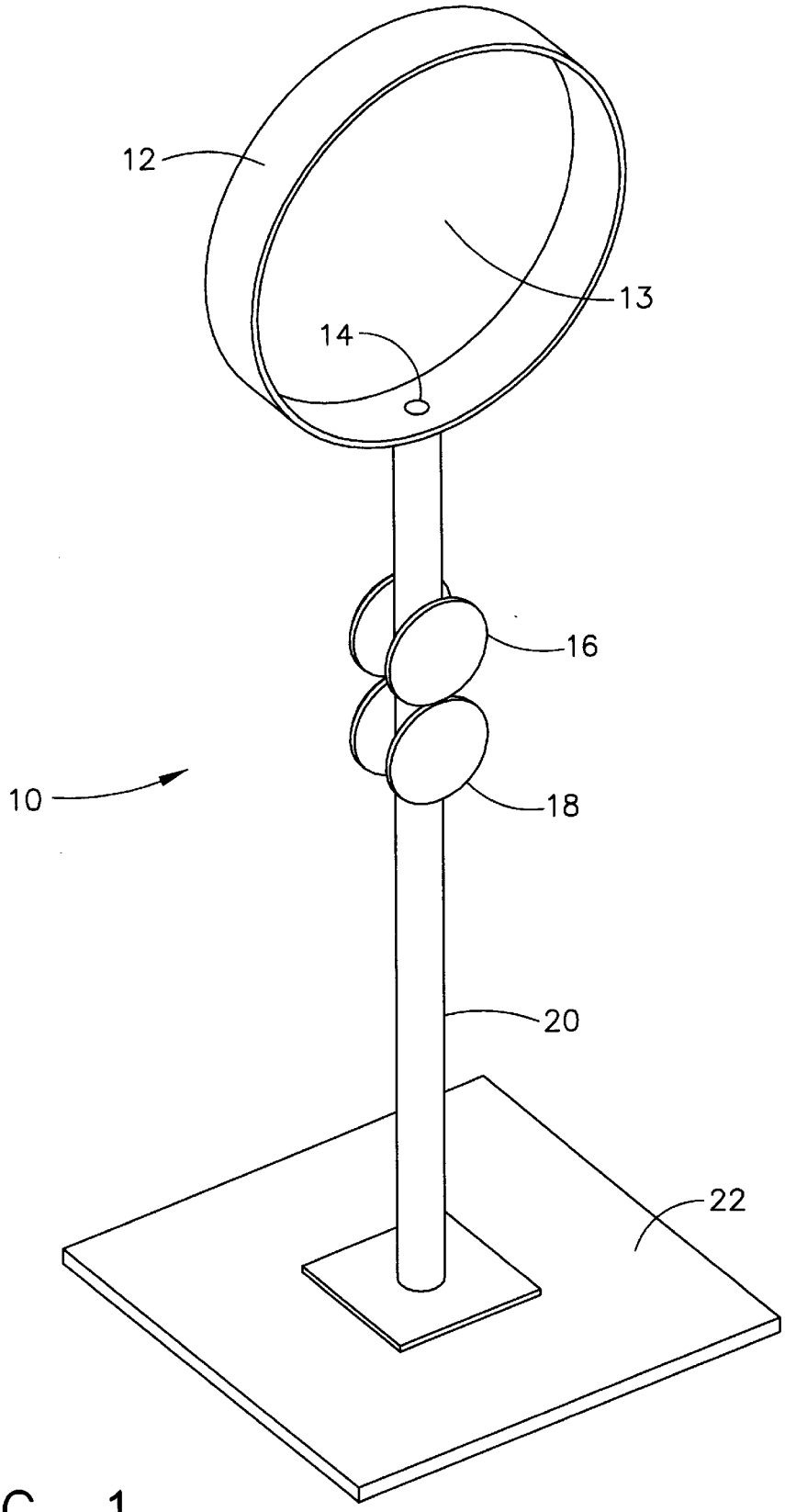
FIG. 1 is a perspective view of the free standing target of the water target game of the present invention.

As best shown in FIG. 1, the free-standing projectile target 10 comprises a projectile target frame 12 fixedly attached at its base to support pole 20. Support pole 20 may be attached to target support base 22 by any conventional manner. Target frame 12 may be configured into substantially any form that is at least partially enclosed so as to define a target area 13. Preferably, frame 12 defines an enclosed circular target area 13. The diameter of target area 13 may be of substantially any dimension depending on the desired amount of skill required to successfully throw a projectile through the target area 13. Preferably, target area 13 has a diameter in the range of about one foot to about twelve feet. In order to verify that a projectile has successfully passed through target area 13, a motion detector 14 is disposed adjacent with target frame 12. Preferably, motion detector 14 is disposed within support pole 20 and is in communication with target frame 12 through corresponding apertures in the support pole 20 and target frame 12. Support pole 20 may be of any appropriate height and is preferably variable in order to facilitate a target of varying height and concomitant difficulty. Support base 22 may be configured of any suitable size so as to render target 10 sufficiently stable to withstand external forces such as wind gusts and impact from projectiles and the like.

Although there is only one target area in the preferred embodiment of the present invention, it should be appreciated that target 10 may comprise more than one target area 13. For example, target 10 could be provided with two openings, such as one target frame mounted beneath another target frame. In this embodiment, each player or team of players could be assigned a particular target. Similarly, target 10 may have four target areas 13, each target area being assigned to one player or team of players when the game is used with four teams.

Additionally, although it is preferred that frame 12 is supported by pole 20, it should be appreciated that target frame 12 could be modular in that it could hang from an upper support or could be mounted onto or built into other structures rather than being mounted on pole 20 without departing from the present invention. Further, several target games of the present invention having various configurations may be used together to create a water target course or water attraction having several stations. Additionally, and in order to provide a cohesive course or game, several different targets may be linked to one centralized control unit, rather than furnishing each individual target with its own control unit.

Figure 2:
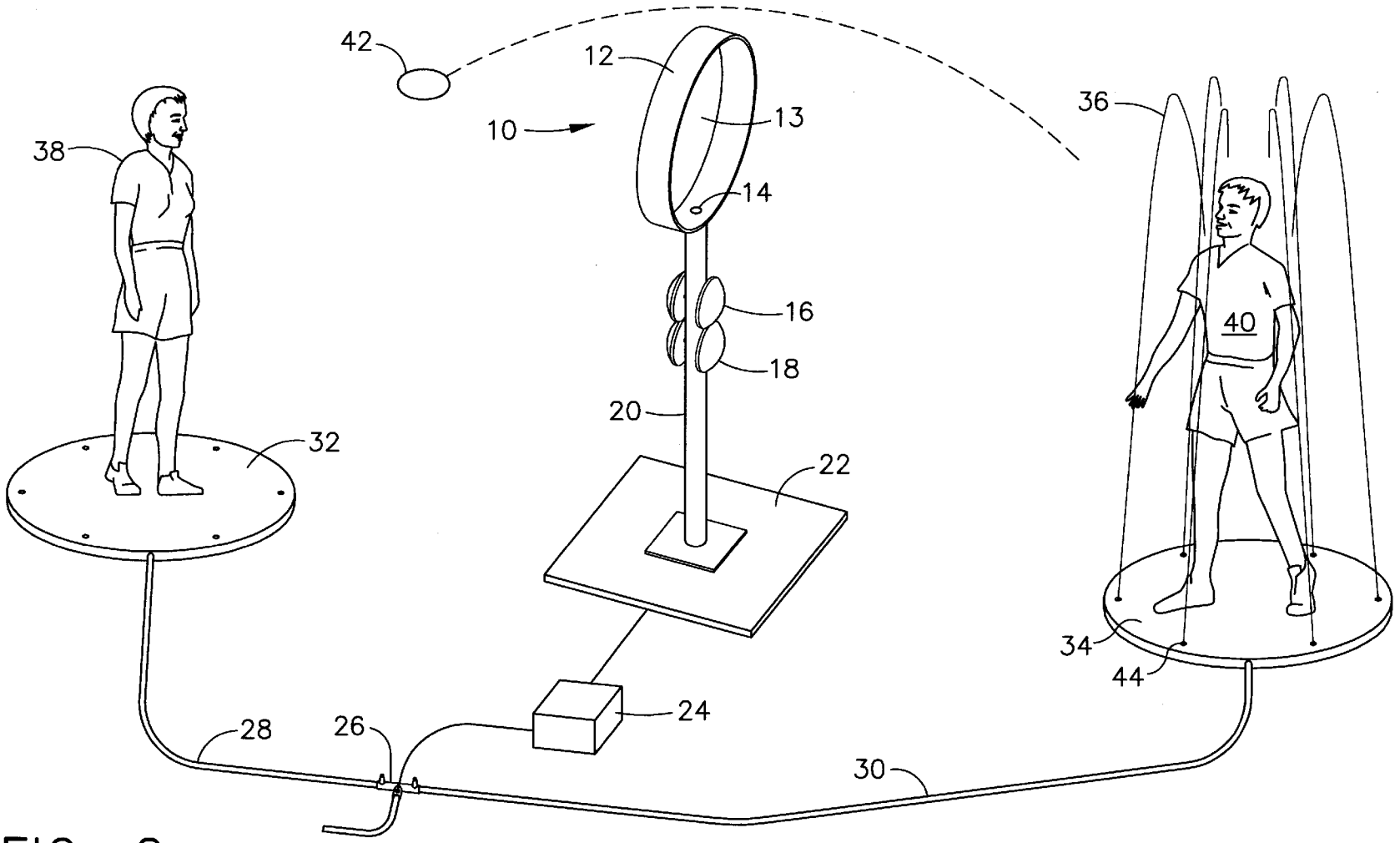
FIG. 2 is a perspective view of the water target game of the present invention showing an unsuccessful player being doused with water upon missing the target with a thrown projectile.
Figure 3:
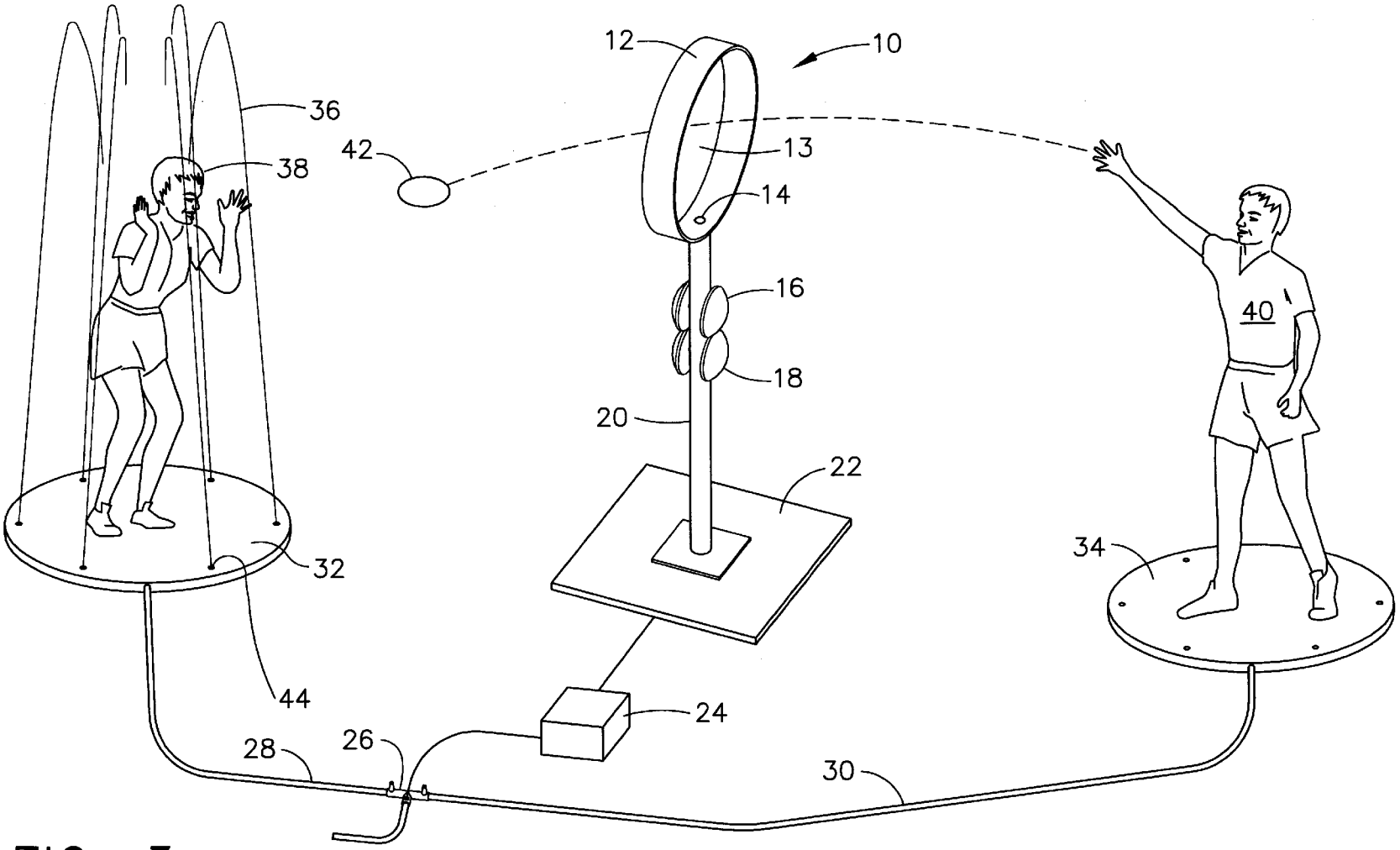
FIG. 3 is a perspective view of the water target game of the present invention showing an opposing player being doused with water when a player is successful in throwing a projectile through a centrally disposed target.

As best shown in FIGS. 2 and 3, target 10 is preferably centrally disposed between first and second player stations or pods 32, 34. Target 10 is oriented such that players on opposing pods 32, 34 face target area 13. Pods 32 and 34 are of a sufficiently durable material to withstand weight of one or more players. Pods 32, 34 further include a plurality of spray nozzles 44 disposed therein. During play, when a first player successfully throws a projectile 42 (such as a suitable ball, ring, foam rubber object or a flying disc) through the target area 13, thus activating the motion detector 14. The motion detector 14 sends a signal to the control unit 24. The control unit 24 then operatively activates the diverting valve 26 allowing pressurized water to flow to the water nozzles 44 in the opposing player's pod. The water nozzles 44 in the opposing players pod are thusly activated and the opposing player or team of players is doused with water. Projectiles 42 may be loose and unencumbered or they may be attached or tethered in some fashion in order to keep the projectile within the vicinity of the target game.

Although in the preferred embodiment, as described above, multiple player pods or stations are used, it should be appreciated that additional configurations may be utilized without departing from the present invention. For example, a player or team of players may stand either within an open ring or around a tube, both having small water holes disposed therein. Additionally, overhead nozzles may be used as well in place of or in addition to the pod nozzle concept. For example, overhead nozzles mounted on free-standing poles or existing overhanging structures may be used to douse unsuccessful players. Additionally, standard sprinklers such as those used for lawn care may be readily adapted for use with the game of the present invention.

In order to increase the water pressure or water flow rate so that more area can be sprayed with increased amounts of water and resultant pressure, water pumps may be added to pump water through the nozzles at an increased rate. In addition, and instead of player pods, rings or the like, a playing area can be demarcated wherein nozzles are built directly into the ground instead of a pod or ring. The playing area in any embodiment may be modified with drains and pumps so that water can be recirculated to both save on water usage and to reduce the amount of water runoff from the game area.

In the preferred embodiment, one or more signal lights 16, 18 are attached to both sides of support pole 20 in such a manner as to be facing each player or team of players. A controller unit 24 is provided that is operatively connected with the lights 16, 18, motion detector 14, and diverting valve 26 which regulates water flow to the spray nozzles 44 onto the pods 32, 34. Preferably, water-tight wiring conduits and water connectors are used. As will be explained hereinafter, controller unit 24 dictates the pace of the game by regulating the illumination of the lights 16, 18. Preferably, the controller unit 24 is programmable so the operators may customize the target game by varying the length of time of signal light illumination and delay, and other features of the game. The controller unit may have toggle switches to allow the operator to switch instantly between various preprogrammed games having varying operational parameters.

For example, in one version of the target game, a signal light (preferably green) 18 facing a first player's pod 34 is steadily illuminated for a predetermined period of time, and subsequently begins flashing for another predetermined amount of time. During the brief flashing period, the player 40 on first pod 34 must throw the projectile 42 through the target area 13 of the target frame 12 in order to be successful. As shown in FIG. 2, if the throw is wide or late (i.e., after the flashing period of the signal light), the controller unit 24 signals diverting valve 26 to open and channel water through hose 30 into the unsuccessful player's pod and out the spray nozzles 44 imbedded therein. If the player is successful in throwing the projectile 42 through the target area 13, diverting valve 26 channels water through hose 28 into the opposing player's pod 32 and through the spray nozzles 44 imbedded therein thus dousing the opposing player as shown in FIG. 3. Although the diverting valve may be positioned in substantially any location where it does not interfere with the game, the diverting valve 26 may be installed in a centralized location, such as the base of the target frame. An additional signal light 16, which is preferably red, may be provided which will illuminate on the side of the "losing" player's pod to indicate which player is about to be doused for the current round, or to indicate to a player(s) on a pod when it is not their turn to throw.

Preferably, signal light 18 will be illuminated for a period of time in a range of about two to fifteen seconds to indicate which pod is currently activated. Preferably, signal light 18 will then flash for a period of time in the range of about one to ten seconds to indicate that the target is activated. If the target activation time frame expires and there has not been a successful throw, the signal light 16 on then offensive player's side illuminates for about one to about five seconds to indicate that the player was unsuccessful. Obviously, several different patterns and durations of lighting to signal the players through the steps of the game may be used without departing from the present invention. Further, sound devices or speakers with pre-recorded instructions may be used to keep the pace of the game in which case the lights would not be necessary. Other sounds may be used as well (for example, cheers, boos, or other crowd noise) to indicate success or failure.

Although it is preferred to use two signal lights, it should be understood that only one light on each side of the target may be used. In this "one light" configuration, the light would turn on to indicate that it is the turn of the person on that side to throw and would flash to indicate that the target is activated. When the light is off in the single light configuration, this would indicate that it is not the person's turn to throw. Additionally, an array of lights similar to those used in drag racing may be used to indicate when the players should start and to dictate the pace of the game.

Once the nozzles 44 on either pod are activated and sprayed, the control unit resets and the cycle starts again. For example, the indicator light on the second pod will illuminate for a brief period of time before flashing for a predetermined amount of time. While the indicator light for the second pod is flashing, the second player or team of players must successfully throw the projectile through the target frame 12 in order to soak the opposing side and to avoid getting wet themselves.

In an alternate embodiment of the target game invention, other sensing means such as light, motion, or pressure sensitive mechanisms may be installed within each pod. Participants would activate the target game system by standing on the pod with the pressure sensitive mechanism installed therein. Preferably, this system would be designed in such a manner so that only one pod would be activated at any given time during the game. During play, the; player or team of players on the activated pod would have a widow of opportunity within which to throw the projectile 42 though the target area 13 and douse the participants on the opposing inactivated pod. Similar to the preferred embodiment, controller unit 24 may control and set the pace of the game by only allowing one pod to be activated for short predetermined time intervals within which the "activated" team must successfully throw the projectile through the target or be doused themselves. Further, if they miss the target, they will be doused as well.

In yet another embodiment of the target game of the present invention, target 10 would have two or more motion detectors that would be capable of sensing from which direction the throw projectile 42 is coming. In this embodiment, all players on pods 32 and 34 would have projectiles 42. Signal lights 18 would illuminate, preferably a flashing green light, on both sides of the target facing each pod 32 and 34, simultaneously prompting the players on pods 32 and 34 to throw their projectiles 42. The player or team of players who successfully throws the projectile 42 through the target frame 12 first wins and the losing players get doused. In this embodiment, in order to maintain the pace of the game, the controller unit could be programmed so that if neither team is successful within a certain predetermined time interval, both sets of nozzles are activated and both teams get wet. Further, there could be a predetermined time period after which the water supply turns off so the players may collect their projectiles 42, get back on their respective pods and prepare to throw again.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, target 10 could be outfitted with many different options such as coin operated mechanisms and the pods could be modified or replaced with in-ground pumps or larger nozzles to douse a larger area. Additional lights and speakers could be installed to incorporate additional special effects and to dictate the pace of the game. The embodiment was chosen and described in order to best illustrate the principles of the invention and its practical application to thereby enable one of ordinary skill in the art to best utilize the invention in various embodiments and with various modifications as are suited to the particular use contemplated.

What is claimed is:

1. A water target game device to accommodate one or more players playing a game with a projectile comprising:

a target; said target being sized to permit said projectile to pass therethrough;

a sensing means associated with said target for detecting when said projectile passes through said target;

a spraying means located in a station or a plurality of stations where said players are situated during the course of said game; said spraying means used to selectively spray water onto said station(s);

a control means in communication with said sensing means and said spraying means for initiating the flow of water through said spraying means so as to provide a water spray onto said player stations;

whereby said control means initiates said water spray onto said station(s) upon receiving a signal from said sensing means.

2. A water target game device of claim 1 further comprising an indicating means which signals to said players of said water target game as to when to or when not to throw said projectile through said target; said indicating means being in communication with said control means and said sensing means to signal to said players of said water target game when said projectile has successfully passed through said target.

3. A water target game device of claim 2 wherein said sensing means is able to detect from which station said projectile was successfully thrown, allowing players from more than one station to simultaneously throw a projectile at said target at the prompt of said indicating means; whereby said control means, upon receiving a signal from said sensing means, initiates said water spray onto all station(s) except that station from where the first successful player to throw a projectile through the target is positioned, hence said first successful player is rewarded by not being sprayed with water.

4. A water target game device of claim 3 wherein said target, said sensing means, said control means, said spraying means and said indicating means are mobile to allow said water target game device to be transported to another location.

5. A water target game device of claim 3 wherein said target, said sensing means, said control means, said spraying means and said indicating means are modular to allow said water target game device to be integrated with other amusement attractions, devices, games, as well as swimming pools, wave pools, water slides and other attractions in water and amusement parks whereby said water target game adds to the enjoyment of said games, devices and attractions.

6. A water target game device of claim 3 wherein said control means contains one or more programmed settings of said indicating means and said spraying means allowing the rules and pace of the game to be readily changed by an operator of said game using manual or electronic switches.

7. A water target game device of claim 3 wherein said target, said control means, said spraying means, said sensing means and said indicating means can be connected to one or more water target game devices with said water target game devices being in communication with each other to allow said players to throw projectiles through various targets to get other players at other stations doused with water.

8. A water target game device to accommodate one or more players playing a game with a projectile comprising:

an upright assembly;

a target located in the upper portion of said assembly; said target being sized to permit said projectile to pass therethrough;

a sensing means associated with said target for detecting when said projectile passes through said target;

a spraying means located in a station or a plurality of stations where said players are situated during the course of said game; said spraying means used to selectively spray water onto said station(s);

an indicating means in the form of a light or plurality of lights located on said assembly with said light(s) functioning as an indicator(s) to said players of said water target game as to when to throw or when not to throw said projectile through said target;

a control means in communication with said sensing means and said spraying means for initiating the flow of water through said spraying means so as to provide a water spray onto said player stations; said control means also being in communication with said indicating means to communicate to said players of said water target game when to throw or not to throw said projectile;

whereby said control means initiates said water spray onto said station(s) upon receiving a signal from said sensing means.

9. A water target game device of claim 8 wherein said sensing means is able to detect from which station said projectile was successfully thrown allowing players from more than one station to simultaneously throw a projectile at said target at the prompt of said indicating means; whereby said control means, upon receiving a signal from said sensing means, initiates said water spray onto all station(s) except that station from where the first successful player to throw a projectile through the target is positioned, hence said first successful player is rewarded by not being sprayed with water.

10. A water target game device of claim 9 wherein said control means contains one or more programmed settings of said control means, said indicating means and said spraying means allowing the rules and pace of the game to be readily changed by an operator of said game using manual or electronic switches.

11. A water target game device of claim 10 wherein said upright assembly with said target, said sensing means, said indicating means, said control means, said spraying means are mobile to allow said water target game device to be relocated to other playing areas.

12. A water target game device of claim 10 wherein said upright assembly with said target, said sensing means, said control means, said spraying means and said indicating means are modular to allow said water target game device to be integrated with other amusement attractions, devices, games, as well as swimming pools, wave pools, water slides and other attractions in water and amusement parks whereby said water target game adds to the enjoyment of said games, devices and attractions.

13. A water target game device of claim 10 wherein said upright assembly with said target, said control means, said spraying means, said sensing means, and said indicating means can be connected to one or more water target game devices with said water target game devices being in communication with each other to allow said players to throw projectiles through various targets to get other players at other stations doused with water.

14. A water target game device of claim 10 wherein said spraying means are imbedded in a circular pod, with said circular pod functioning as a platform and station for said players to stand on while playing said game.

15. A water target game device of claim 10 wherein said spraying means consist of a hollow circular ring with small holes through which pressurized water can be expelled thereby spraying said players positioned inside or in close proximity to the outside of said ring, with said circular ring functioning as an area or station for said players to stand inside of or near to while playing said game.

16. A water target game device of claim 10 wherein said spraying means are mounted on or imbedded in the upright assembly of said water target game device either above or below said target, with spraying means having the ability to douse said players with water while they play said game.

17. A water target game device of claim 10 wherein said spraying means consist of a hollow tube with small holes through which pressurized water can be expelled thereby spraying said players positioned in close proximity to said tube, with said tube defining an area or station for said players to stand near while playing said game.

18. A water target game device of claim 10 wherein a noise making apparatus is used in conjunction with or in place of said indicator lights as an indicating means to signal to said players of said game when to or when not to throw said projectile; said noise making apparatus also functioning as a means of enhancing the enjoyment of the game with audio special effects.

19. A water target game device of claim 10 wherein a coin or token operated device may be used in conjunction with said water game device to regulate play and/or to generate income for operators of said water target game device.

20. A water target game device of claim 10 further comprising a regulating means which signals to said control means when said players are in position to play said water target game; whereby upon receiving a signal from said regulating means, said control means activates said indicating means to communicate to said players of said water target game when to throw said projectile at said target; said regulating means being activated when said players are in proper position to participate in said water target game.

* * * * *